US005503227A

United States Patent [19]

Saponja et al.

[11] Patent Number: 5,503,227

[45] Date of Patent: Apr. 2, 1996

[54] METHODS OF TERMINATING UNDESIRABLE GAS MIGRATION IN WELLS

[75] Inventors: Jeffrey C. Saponja; Orville R. Cole, both of Calgary, Canada

[73] Assignees: Halliburton Company; Husky Oil Drilling and Completions, both of Duncan, Okla.

[21] Appl. No.: 441,167

[22] Filed: May 15, 1995

[51] Int. Cl.[6] ..... E21B 33/13; E21B 33/138

[52] U.S. Cl. ..... 166/277; 166/281; 166/283; 166/292

[58] Field of Search ..... 166/277, 281, 166/283, 285, 292, 298

[56] References Cited

U.S. PATENT DOCUMENTS

| | | | |
|---|---|---|---|
| 3,237,690 | 3/1966 | Karp et al. | 166/283 X |
| 3,346,048 | 10/1967 | Strange et al. | 166/281 X |
| 3,967,681 | 7/1976 | Curzon | 166/277 |
| 4,673,039 | 6/1987 | Mohaupt | 166/281 |
| 5,123,487 | 6/1992 | Harris et al. | 166/277 |
| 5,125,455 | 6/1992 | Harris et al. | 166/292 |
| 5,127,473 | 7/1992 | Harris et al. | 166/277 |
| 5,295,541 | 3/1994 | Ng et al. | 166/277 |
| 5,375,661 | 12/1994 | Daneshy et al. | 166/285 X |

OTHER PUBLICATIONS

*Hydraulic Fracturing*, Howard, G. C. and C. R. Fast; SPE, New York. 1970. pp. 94–100.

*Primary Examiner*—George A. Suchfield
*Attorney, Agent, or Firm*—Craig W. Roddy; Robert A. Kent

[57] ABSTRACT

The present invention relates to a method of terminating undesirable gas migration in a well through one or more passages such as channels and microannuli in the cement sheath holding the casing in the well bore. The methods basically comprise forming one or more lateral openings through the casing and the cement sheath into a substantially gas impermeable formation penetrated by the well bore. One or more horizontal fractures are created in the formation extending from the lateral openings, and a fluid which sets into a substantially gas impermeable solid is deposited in the openings and fractures. The fluid is permitted to set into a substantially gas impermeable solid in the openings and fractures whereby passages in the cement sheath are plugged and gas migration is terminated.

20 Claims, 4 Drawing Sheets

METHODS OF TERMINATING UNDESIRABLE GAS MIGRATION IN WELLS

BACKGROUND OF THE INVENTION

1. Field of the Invention

This invention relates generally to methods of terminating undesirable gas migration in wells, and more particularly, to such methods which are relatively simple and inexpensive to carry out.

2. Description of the Prior Art

After a well bore is drilled by rotary drilling wherein a drilling fluid is circulated through the well bore, the circulation of the drilling fluid is stopped and a production casing string is typically run into the well bore. After the casing has been run, primary cementing is performed. That is, the string of casing disposed in the well bore is cemented therein by placing a cement slurry in the annulus between the casing and the walls of the well bore. The cement slurry is permitted to set into a sheath of hard substantially impermeable cement in the annulus which holds the casing in the well bore and is intended to bond the casing to the walls of the well bore whereby the annulus is sealed.

Undesirable gas migration in a well is the migration of gas in the annulus from one or more pressurized gas formations or zones penetrated by the well bore during and after primary cementing. The gas migration can be between formations or zones, e.g., from a high pressure zone to a low pressure zone, or the gas migration can be from one or more gas zones to the surface.

It is widely believed that gas migration is caused by the behavior of the cement slurry during the transition phase in which the cement slurry changes from a fluid to a highly viscous mass having some solid characteristics. The transition phase starts when the cement slurry develops enough static gel strength to restrict the transmission of hydrostatic pressure over its column height, and ends when the cement slurry develops a gel strength which is sufficient by itself to prevent the migration of gas through the cement slurry. If the hydrostatic pressure exerted on one or more pressurized gas formations or zones by the cement slurry falls below the pressure of the gas in the zones, the gas enters the annulus and migrates through the cement slurry. The initial gas migration causes passages, e.g., flow channels or very small annular spaces between the casing, the cement column and the walls of the well bore known as "microannuli" to be formed. Such flow channels and microannuli remain after the cement slurry sets and undesirable gas migration continues.

While numerous techniques have been developed and used heretofore for preventing the formation of passages in the cement sheath in a well through which gas migration can occur, such techniques are not always successful and gas migration still results. Such gas migration often travels to the surface in wells which penetrate shallow gas zones.

The elimination of surface gas migration has heretofore been difficult, particularly in wells which penetrate shallow gas zones up-hole from the completed producing formation or formations. The shallow gas zones usually have very low permeability, and often include clays which swell upon contact with water thereby making it difficult to introduce cement for plugging the zones thereinto. Generally, the heretofore utilized techniques for eliminating undesirable surface gas migration have been unreliable, difficult to carry out and very expensive. Thus, there is a need for an improved relatively simple and inexpensive method of terminating undesirable gas migration in wells, particularly in wells where the gas migration originates from relatively shallow gas zones.

SUMMARY OF THE INVENTION

The present invention provides methods of terminating undesirable gas migration in wells which meet the need described above and overcome the shortcomings of the prior art. The methods apply to the termination of undesirable gas migration in a well comprised of a well bore having casing held therein by a cement sheath wherein the gas migration occurs at least in part through one or more passages such as channels and microannuli in the cement sheath or near the well bore in the formation.

The methods basically comprise the steps of locating a substantially gas impermeable formation penetrated by the well bore through which the gas migration occurs by way of passages in the cement sheath. One or more lateral openings through the casing and through the cement sheath into the substantially gas impermeable formation are then formed, and one or more horizontal fractures are created in the formation extending from the lateral openings. A fluid which sets into a substantially gas impermeable solid is next deposited in the openings and fractures, and the fluid is caused to set into a substantially gas impermeable solid in the openings and fractures whereby the passages in the cement sheath are plugged and the gas migration is terminated.

It is, therefore, a general object of the present invention to provide improved methods of terminating undesirable gas migration in wells.

A further object of the present invention is the provision of methods of terminating undesirable gas migration in wells which are relatively simple and inexpensive to carry out.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
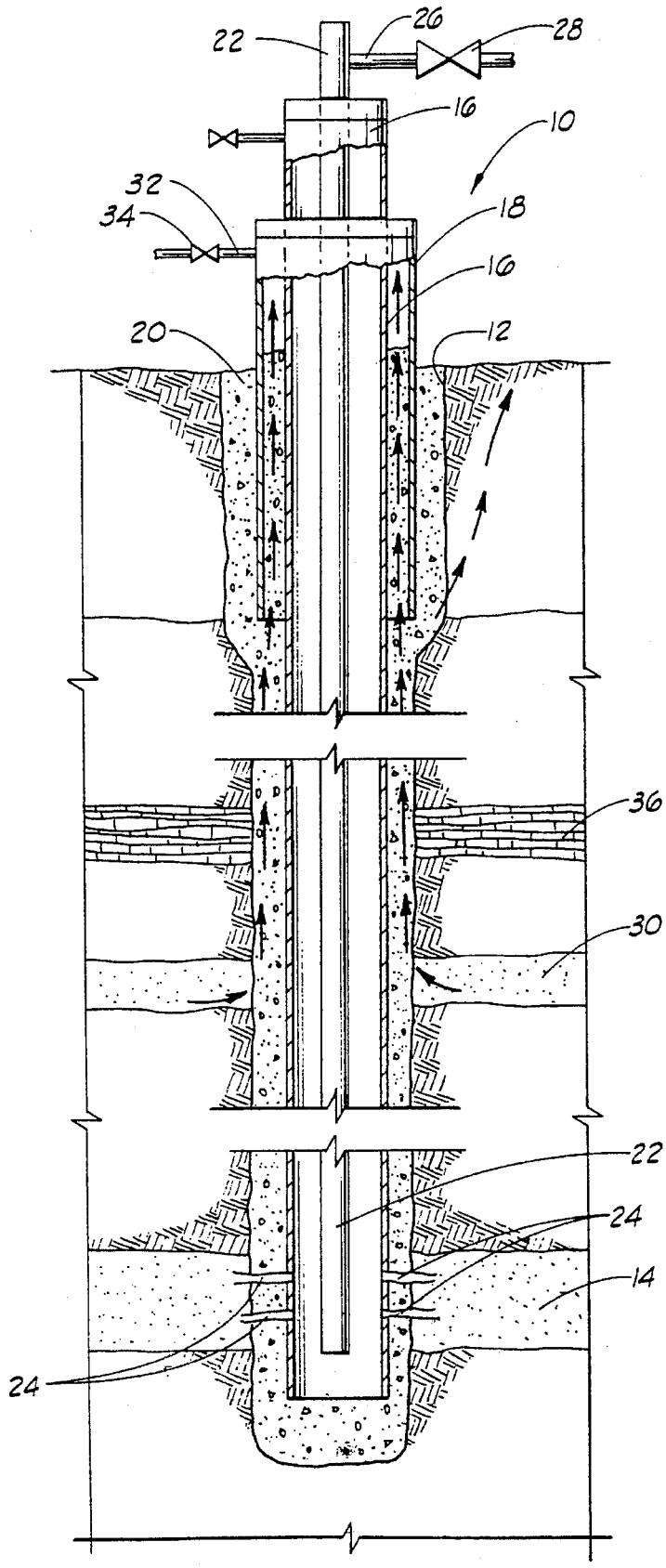
FIG. 1 is a schematic illustration of a well which penetrates a producing formation and also penetrates a shallow gas zone from which gas migrates to the surface.
Figure 2:
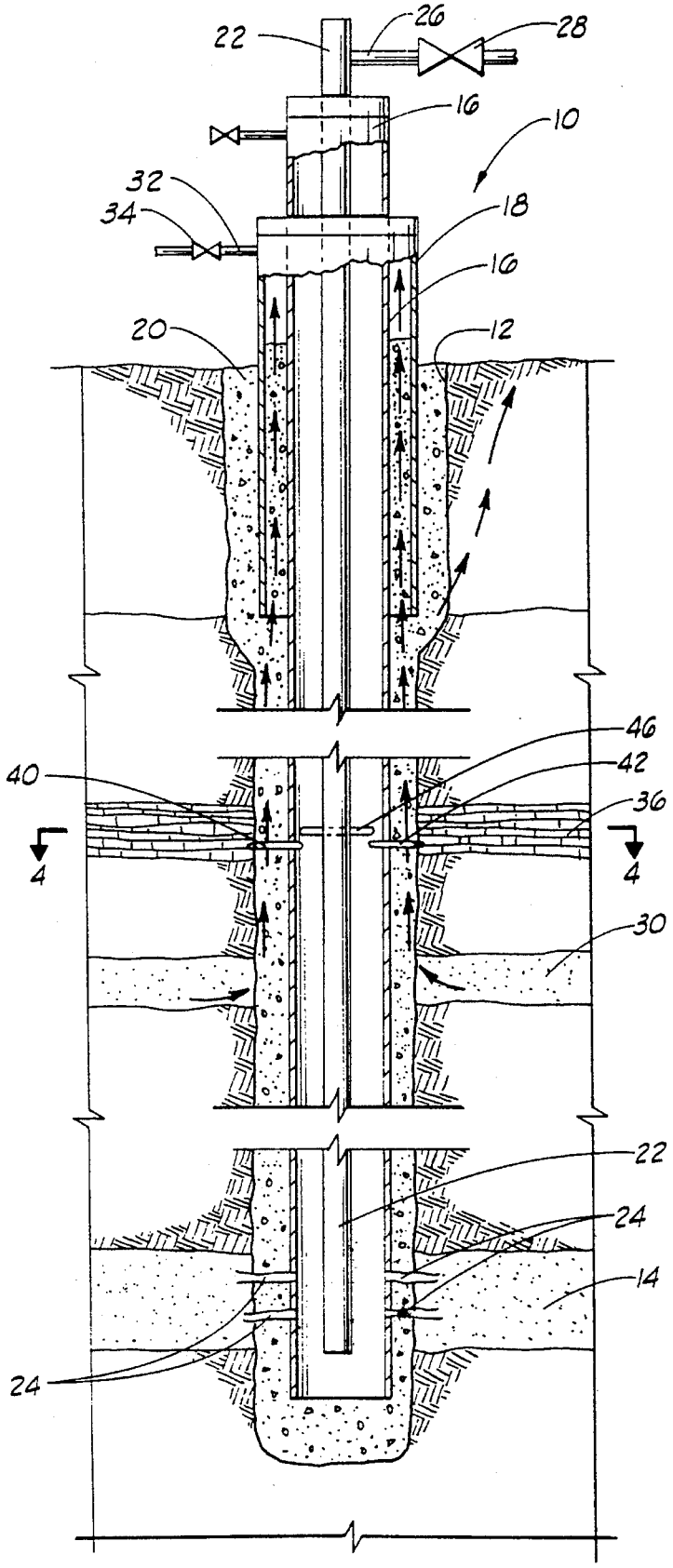
FIG. 2 is a schematic illustration of the well after a plurality of slots have been formed through the casing and cement sheath thereof into a substantially gas impermeable formation.

In primary well cementing, a cement sheath is formed in the annular space between casing disposed in a well bore and the walls of the well bore. The cement sheath is generally formed by displacing a pumpable hydraulic cement slurry downwardly through the casing and upwardly into the annulus between the casing and the well bore. After being placed, the cement slurry is permitted to remain in a static state in the annulus whereby it sets into a hard impermeable mass therein. The resulting cement sheath provides physical support and positioning to the casing in the well bore and is intended to provide a bond between the casing and the walls of the well bore whereby the annulus is sealed.

As mentioned above, primary cementing operations are often unsuccessful in sealing the annulus and preventing gas migration therethrough. Gas migration takes place in a well bore which penetrates one or more pressurized gas zones as a result of the hydrostatic pressure exerted in the well bore by the cement slurry falling below the gas zone pressure. When the gas pressure is higher than the hydrostatic pressure, gas enters and flows through the well bore before the cement slurry develops sufficient gel strength to prevent such gas entry and flow. Gas migration through the set cement slurry continues through passages remaining therein whereby the gas is free to flow to the surface and/or between zones penetrated by the well bore. The passages formed in the cement sheath usually take the form of flow channels or very thin annular spaces between the casing, the cement sheath and the walls of the well bore known as microannuli.

By the present invention, improved methods of terminating undesirable gas migration in a well are provided. A well to which the methods are applicable is comprised of a well bore having casing or other pipe held therein by a cement sheath and gas migration occurs at least in part through one or more passages such as channels and microannuli in the cement sheath or in the formation near the well bore as a result of formation damage.

The improved methods of this invention for terminating undesirable gas migration in a well of the type described above basically comprise the steps of locating a substantially gas impermeable formation penetrated by the well bore through which the gas migration occurs by way of passages in the cement sheath. One or more lateral openings are formed through the casing and cement sheath into the substantially gas impermeable formation, and one or more horizontal fractures are created and extended in the formation from the lateral openings. A fluid which sets into a substantially gas impermeable solid is deposited in the openings and in the fractures in the substantially gas impermeable formation, and the fluid is caused to set into a solid therein. The gas impermeable solid plugs the passages in the cement sheath and provides a seal between the cement sheath and the substantially gas impermeable formation whereby gas migration is blocked and terminated.

The initial step of locating a substantially gas impermeable formation penetrated by the well bore through which the undesirable gas migration occurs by way of passages in the cement sheath can usually be accomplished by a study of the open hole log or logs run on the well when it was drilled. If no previously run logs are available, a new log can be run. A substantially gas impermeable formation for purposes of this invention is a formation which has a relatively high compressive strength and low permeability and porosity whereby the pressurized gas which is the source of the gas migration can not fracture or permeate through the formation.

Referring now to FIGS. 1–5 of the drawings, a well generally designated by the numeral 10 is schematically illustrated. The well 10 is comprised of a well bore 12 which penetrates a subterranean producing formation 14. A string of production casing 16 is disposed in the well bore 12 extending from the surface through the producing formation 14 to a point near the bottom of the well bore 12. The well 10 also includes a relatively short string of surface casing 18. The production casing 16 and surface casing 18 are held in the well bore by a cement sheath 20 disposed within the annulus between the production casing 16 and surface casing 18 and the walls of the well bore 12. A string of production tubing 22 is disposed within the production casing 16. The production tubing 22 extends from the surface to the producing formation 14.

The producing formation is communicated with the interior of the production casing 16 by a plurality of perforations 24, and hydrocarbons from the producing formation 14 flow through the perforations 24 into the production casing string 16 and upwardly by way of the open bottom of the tubing string 22 into and through the tubing string 22 to the surface. A conduit 26 containing a valve 28 conducts the produced hydrocarbons to storage or further processing.

The well bore 12 penetrates a pressurized gas zone 30 which is above the producing zone 14 or which may comprise a part of the producing zone and which is the source of undesirable gas migration (shown by arrows) through passages in the cement sheath 20 into the surface casing 18. Some of the gas which migrates upwardly in the annulus enters the soil layer adjacent the surface and flows therethrough to the surface. The gas collected within the surface casing can be vented by way of a conduit 32 connected to the surface casing and containing a valve 34 to a point of use or disposal. The gas which migrates through the soil surrounding the well 10 constitutes a hazard to the environment and personnel.

In carrying out the present invention for terminating the gas migration from the pressurized gas zone 30 associated with the well 10, as mentioned above the first step is to locate a substantially gas impermeable formation 36 through which the migrating gas from the pressurized gas zone 30 flows. Since the formation 36 is a substantially gas impermeable formation, the migrating gas must pass through the formation by way of passages either in or very near the cement sheath 20.

Figure 4:
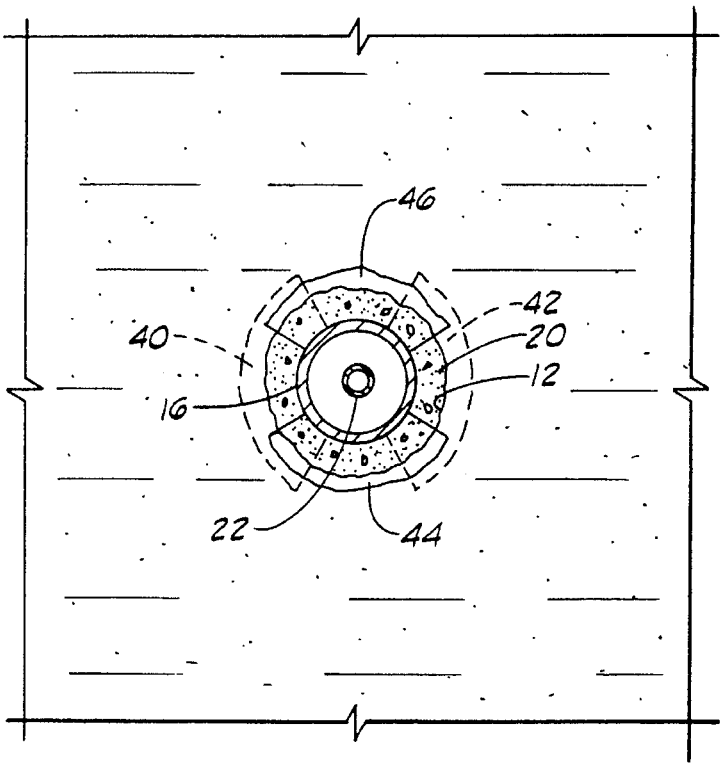
FIG. 4 is a schematic illustration of the well taken along line 4—4 of FIG. 2.

The next step involves the formation of one or more lateral openings through the production casing 16 and through the cement sheath 20 into the gas impermeable formation 36. Preferably, the lateral openings are comprised of a plurality of horizontal slots which are coextensive with a horizontal annular area extending from the inside surfaces of the production casing 16 into the formation 36. In the drawings, the use of four overlapping horizontal slots 40, 42, 44 and 46 which extend through the casing 16, through the cement sheath 20 and into the gas impermeable formation 36 is illustrated. As best shown in FIG. 4, the horizontal slots 40 and 42 are opposite each other and are on the same level while the horizontal slots 44 and 46 are opposite each other on a level a short distance above the slots 40 and 42. Also, the slots are angular whereby they are coextensive with a horizontal annular area around the casing 16. Each of the slots 40, 42, 44 and 46 has a shape corresponding to an annular segment the angle of which is generally in the range of from about 91° to about 120°, preferably about 110°.

As will be understood by those skilled in the art, a number of slots greater or less than four can be utilized. Also, a single circular slot can be formed through the casing 16 and cement sheath 20, but it is preferred that more than one disconnected slot be used to avoid completely severing the casing and cement sheath whereby shifting between the upper and lower parts could occur.

The slots 40, 42, 44 and 46 can be formed in the casing 16, cement sheath 20 and formation 36 in any convenient manner. A preferred technique for forming the slots is to utilize an abrasive hydro-jetting process. Abrasive hydro-jetting processes are well known to those skilled in the art and direct a high velocity jet of a fluid containing abrasive particles against a surface to be cut. In the application of the present invention, a tool can be utilized which simultaneously directs high velocity jets of the abrasive fluid against opposite portions of the casing 16, the cement sheath 20 and the formation 36 while rotating the tool over the desired angle to form two opposing horizontal slots, e.g., 40 and 42, simultaneously. As is generally understood, the term "horizontal" is used herein to mean about 90° from vertical and deviations therefrom in the range of from about 600° to about 120° from vertical.

Figure 3:
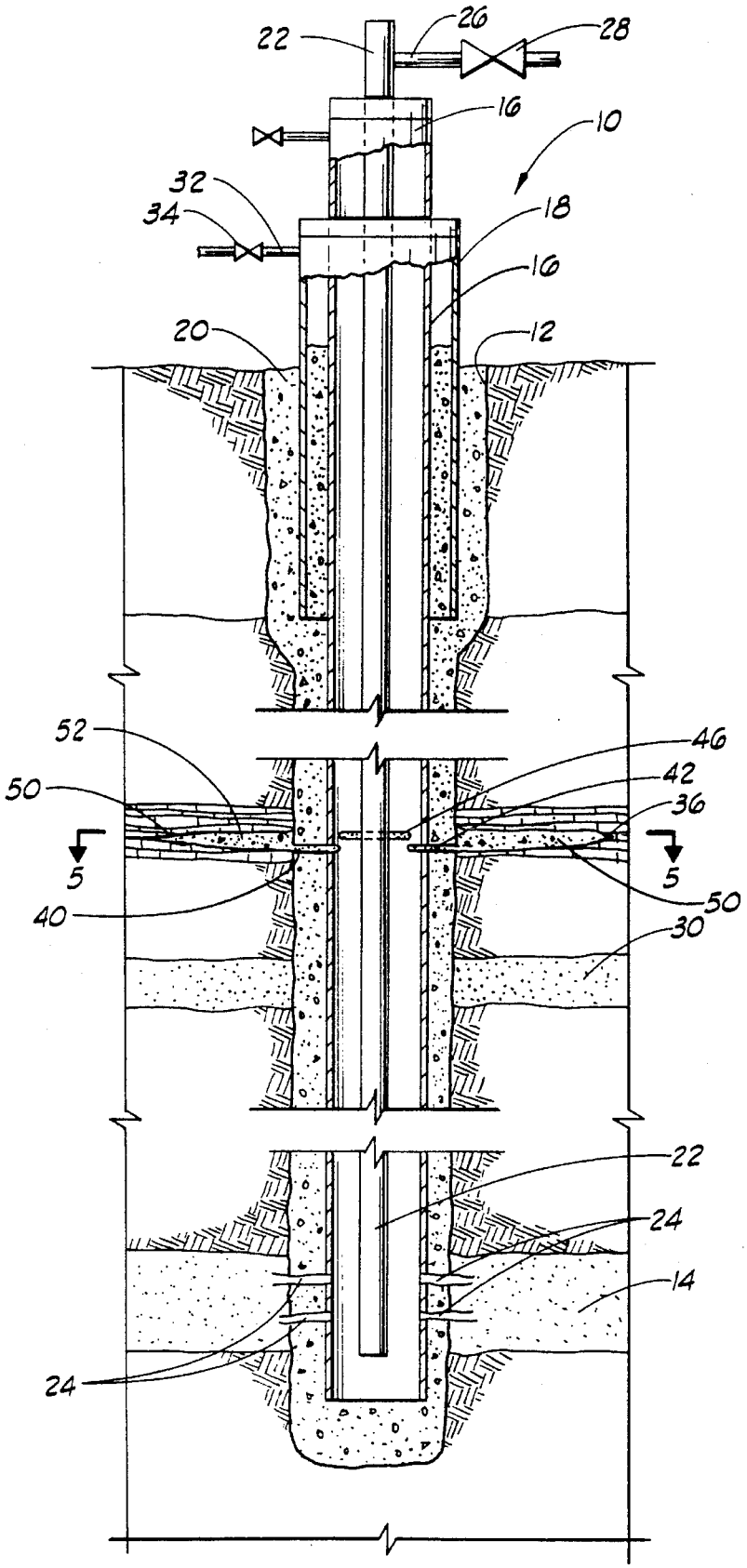
FIG. 3 is a schematic illustration of the well after cement has been placed in the slots formed therein as well as in fractures formed in the substantially gas impermeable formation.
Figure 5:
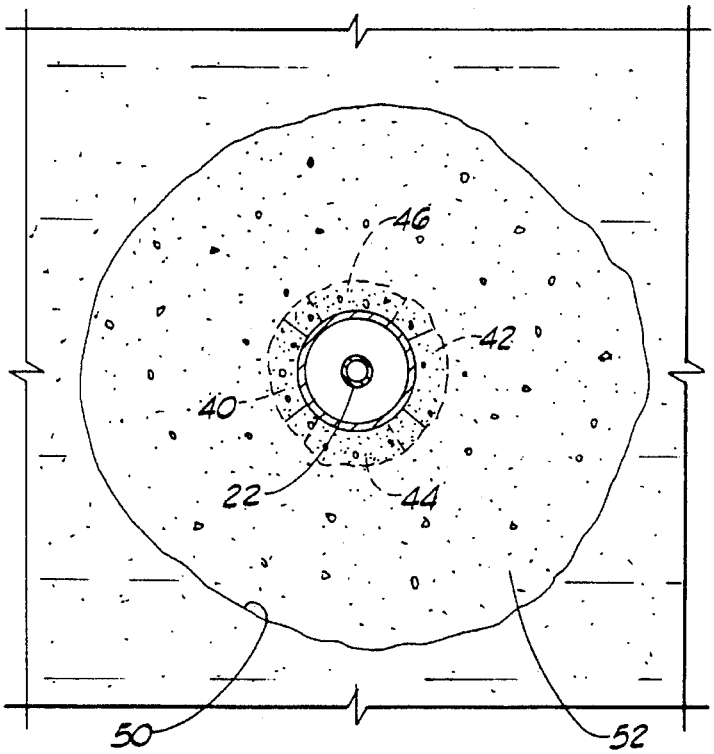
FIG. 5 is a schematic illustration of the well taken along line 5—5 of FIG. 3.

After the horizontal overlapping slots 40, 42, 44 and 46 are formed, one or more horizontal fractures extending from the slots covering a continuous or near continuous annular area are created in the formation 36. The fractures are created by applying fluid pressure to the formation 36 by way of the slots 40, 42, 44 and 46. That is, a fracturing fluid is pumped into the formation 36 by way of the slots at a rate and pressure to create and extend one or more horizontal fractures in the formation 36. Because the slots overlap, the fractures formed also overlap and are usually communicated whereby a single annular fracture 50 extending into the formation 36 is formed as illustrated in FIGS. 3 and 5. As is understood by those skilled in the art, the horizontal slots formed in the formation 36 through which fluid pressure is applied promote the creation of fractures in the horizontal plane.

A fluid which sets into a substantially gas impermeable solid 52 is deposited in the slots 40, 42, 44 and 46 and in the fractures 50. After deposit, the fluid is caused to set in the slots 40, 42, 44 and 46 and in the fractures 50 whereby the gas migration passages in the cement sheath 20 are plugged, the annulus is sealed and the gas migration is terminated.

As will be understood, the fracturing fluid utilized for forming the fractures 50 can be the fluid which sets into a substantially gas impermeable solid, and once the fractures are formed the fluid can be caused to set by permitting it to remain in the fractures 50 under sufficient pressure to maintain the fractures 50 in the open position.

Any of a variety of fluids which set into a substantially gas impermeable solid can be utilized in accordance with this invention. Examples of such fluids are aqueous slurries of Portland cement, high alumina cement, slag, fly ash, gypsum cement and other similar cementitious materials as well as mixtures of the materials. A variety of single component and multi component hardenable resinous materials can also be utilized including acrylic, epoxy and phenolic resinous materials. Combinations of such resinous materials with the above described cementitious and other materials can also be utilized. Of the various fluids which can be used, an aqueous cement slurry is preferred. The most preferred cement is a fine particle size Portland cement or mixture of Portland cement and slag. Such fine particle size cements are described in U.S. Pat. No. 5,086,850 entitled "Squeeze Cementing" issued on Jun. 16, 1992 and assigned to the assignee of this present invention. U.S. Pat. No. 5,086,850 is incorporated herein by reference.

Fine particle size Portland cement or mixtures thereof with slag useful in accordance with this invention are preferably made up of particles having diameters no larger than about 30 microns, most preferably no larger than about 11 microns. The distribution of the various sizes of particles within the cement is preferably such that 90% of the particles have a diameter no greater than about 25 microns, most preferably about 7 microns, 50% of the particles have a diameter no greater than about 10 microns, most preferably about 4 microns and 20% of the particles have a diameter no greater than about 5 microns, most preferably about 2 microns. The Blaine Fineness of the particles is preferably no less than about 6,000 square centimeters per gram. Most preferably the Blaine Fineness is no less than about 13,000 square centimeters per gram. An aqueous slurry of fine particle size Portland cement or Portland cement and slag quickly develops gel strength after placement. Further, because of the fine particle size, the cement slurry enters the very small passages in the cement sheath through which gas migrates and readily bonds thereto whereby such openings are plugged.

A particularly preferred method of the present invention for terminating undesirable gas migration in a well comprised of a well bore having casing held therein by a cement sheath, and the gas migration occurs at least in part through one or more passages in the cement sheath is as follows. One or more lateral openings, preferably one or more slots, are formed through the casing and the cement sheath into a substantially gas impermeable formation, such as, for example, a reservoir cap rock, through which the gas migration occurs by way of the passages in the cement sheath or near the well bore in the formation. A fluid which sets into a substantially gas impermeable solid is next pumped into the substantially gas impermeable formation by way of the lateral openings at a rate and pressure to create and extend one or more horizontal fractures in the formation. The pumping of the fluid is terminated while maintaining the fluid in the openings and fractures, and the fluid is permitted to set into a substantially gas impermeable solid in the openings and fractures whereby the passages in the cement sheath are plugged and the gas migration is terminated. As mentioned above, the fluid that sets into a substantially gas impermeable solid is preferably an aqueous fine particle size Portland cement composition. The fluid is maintained in the openings and fractures and permitted to set therein by shutting in the well under a pressure which maintains the fractures in the open position for a time period sufficient for the fluid to set.

As will now be understood by those skilled in the art, the presence of the set cement or other gas impermeable fluid in the slots formed in the casing and cement sheath plugs the passages in the cement sheath whereby gas is prevented from flowing through the passages. Since the set cement or other fluid extends from the slots into fractures in a substantially gas impermeable formation and the set cement or other fluid is bonded to the formation, the gas below the set cement or fluid is prevented from migrating around the plugged cement sheath.

In order to further illustrate the present invention, the following Example is given.

EXAMPLE

A well drilled in 1982 to a total depth of about 3,000 feet was completed in the Cutbank and Livingstone formations in southern Alberta, Canada. The well included surface casing to about 469 feet and production casing to total depth. Immediately after completion, a surface casing gas vent flow was discovered at an average flow rate of about 12,350 cubic feet per day. The vent flow was the result of gas migration at least in part through the primary cement sheath in the well.

Subsequently, a gas zone which was thought to be the source of the undesirable gas migration was identified at about 1,640 feet. An attempt was made to plug the gas zone by perforating and squeezing cement into the zone without success.

Subsequently, the method of the present invention was performed on the well as follows. An abrasive hydro-jetting tool with 180° opposed nozzles was positioned adjacent a substantially gas impermeable formation located at about 649 feet. Utilizing 20/40 mesh sand and clay swelling inhibited water, two opposed 110° horizontal slots were abrasively cut through the production casing and the cement sheath into the formation. Two additional opposed 110° horizontal slots were cut on a center line 90° from the center line of the initial slots at a level about one foot above the initial slots. Four overlapping 110° horizontal slots were thus formed through the production casing and the cement sheath into the gas impermeable formation. Using clay swelling inhibited water, the formation was fractured. A fine particle size cement slurry having an average cement particle size of 5 microns was then squeezed into the slots through the casing and cement sheath and into the fractures in the formation. The well was shut-in after the cement thickening time was exceeded under high pressure (about 800 psi–1000 psi) overnight during which time the cement set. Thereafter, no measurable gas flow from the production casing vent occurred indicating that the undesirable gas migration was terminated.

Thus, the present invention is well adapted to carry out the objects and attain the ends and advantages mentioned as well as those which are inherent therein. While numerous changes may be made to the compositions and methods by those skilled in the art, such changes are encompassed within the spirit of this invention as defined by the appended claims.

What is claimed is:

1. A method of terminating undesirable gas migration in a well comprised of a well bore having casing held therein by a cement sheath deposited between the casing and the walls of the well bore, said undesirable gas migration occurring at least in part through one or more passages such as channels and microannuli in the cement sheath or near the well bore in the formation, comprising the steps of:

(a) forming one or more lateral openings through said casing and cement sheath into a substantially gas impermeable formation penetrated by said well bore through which said gas migration occurs by way of said passages in said cement sheath;

(b) creating one or more horizontal fractures in said formation extending from said lateral openings;

(c) depositing a fluid which sets into a substantially gas impermeable solid in said openings and fractures; and (d) causing said fluid to set into a substantially gas impermeable solid in said openings and fractures whereby said passages in said cement sheath are plugged and said gas migration is terminated.

2. The method of claim 1 wherein said one or more lateral openings formed in accordance with step (a) are horizontal slots.

3. The method of claim 2 wherein said one or more horizontal slots are coextensive with a horizontal annular area extending from the inside surfaces of said casing into said formation.

4. The method of claim 1 wherein said horizontal fractures created in accordance with step (b) are created by applying fluid pressure to said formation by way of said lateral openings.

5. The method of claim 4 wherein said fluid used for applying fluid pressure to said formation is a fluid which sets into a gas impermeable solid.

6. The method of claim 5 wherein said fluid which sets into a substantially gas impermeable solid is an aqueous cement slurry.

7. The method of claim 1 wherein said fluid which sets into a gas impermeable solid deposited in said openings and fractures in accordance with step (c) is an aqueous cement slurry.

8. The method of claims 6 or 7 wherein said aqueous cement slurry is an aqueous ultra fine Portland cement slurry.

9. The method of claim 2 wherein said one or more horizontal slots are formed by abrasive hydro-jetting.

10. A method of terminating undesirable gas migration in a well comprised of a well bore having casing held therein by a cement sheath deposited between the casing and the walls of the well bore, said undesirable gas migration occurring at least in part through one or more passages such as channels and microannuli in the cement sheath or near the well bore in the formation, comprising the steps of:

(a) locating a substantially gas impermeable formation penetrated by said well bore through which said gas migration occurs by way of said passages in said cement sheath;

(b) forming one or more lateral openings through said casing and cement sheath into said formation;

(c) pumping a fluid which sets into a substantially gas impermeable solid into said formation by way of said openings at a rate and pressure to create and extend one or more horizontal fractures in said formation;

(d) terminating said pumping while maintaining said fluid in said openings and fractures; and (e) permitting said fluid to set into a substantially gas impermeable solid in said openings and fractures whereby said passages in said cement sheath are plugged and said gas migration is terminated.

11. The method of claim 10 wherein said one or more lateral openings formed in accordance with step (b) are horizontal slots.

12. The method of claim 11 wherein said one or more horizontal slots are coextensive with a horizontal annular area extending from the inside surfaces of said casing into said formation.

13. The method of claim 10 wherein said fluid which sets into a substantially gas impermeable solid is an aqueous cement slurry.

14. The method of claim 13 wherein said aqueous cement slurry is an aqueous ultra fine Portland cement slurry, said ultra fine Portland cement having a particle size no greater than about 30 microns.

15. The method of claim 13 wherein said one or more horizontal slots are formed by abrasive hydro-jetting.

16. A method of terminating undesirable gas migration in a well occurring at least in part through one or more passages such as channels and microannuli in the cement sheath or near the well bore in the formation, the well being comprised of a well bore having casing held therein by a cement sheath deposited between the casing and the walls of the well bore, comprising the steps of:

(a) locating a substantially gas impermeable formation penetrated by said well bore through which said gas migration occurs by way of said passages in said cement sheath;

(b) forming one or more horizontal slots laterally through said casing which are coextensive with a horizontal annular area extending from the inside surfaces of said casing into said formation;

(c) pumping an aqueous cement slurry into said formation by way of said slots at a rate and pressure to create and extend one or more horizontal fractures in said formation;

(d) terminating said pumping and shutting in said well under pressure to maintain said aqueous cement slurry in said openings and fractures; and (e) permitting said aqueous cement slurry to set into a substantially gas impermeable mass in said slots and fractures whereby said passages in said cement sheath are plugged and said gas migration is terminated.

17. The method of claim 16 wherein said well is shut in at a pressure at least equal to that required to maintain said fracture or fractures containing said aqueous cement slurry open for the period of time required for said cement slurry to set.

18. The method of claim 16 wherein said cement slurry is an aqueous Portland cement slurry.

19. The method of claim 16 wherein said cement slurry is an aqueous ultra fine Portland cement slurry, the ultra fine Portland cement having a particle size no greater than about 30 microns and a Blaine Fineness no less than about 6,000 square centimeters per gram.

20. The method of claim 19 wherein said one or more horizontal slots are formed by abrasive hydro-jetting.

* * * * *